US005259511A

United States Patent [19]

Pierson

[11] Patent Number: 5,259,511

[45] Date of Patent: Nov. 9, 1993

[54] SLIDING CONDUIT CONNECTOR FOR SCREENING MACHINE

[75] Inventor: Bruce A. Pierson, Cincinnati, Ohio

[73] Assignee: Rotex, Inc., Cincinnati, Ohio

[21] Appl. No.: 767,247

[22] Filed: Sep. 27, 1991

[51] Int. Cl.[5] ..... B07B 1/00

[52] U.S. Cl. ..... 209/240; 209/371; 138/120; 138/173; 285/9.2; 285/16; 285/226

[58] Field of Search ..... 209/240, 241, 242, 243, 209/247, 332, 371; 285/9.2, 16, 226; 138/109, 120, 122, 173, 177, 178; 198/535, 536, 771; 193/25 E

[56] References Cited

U.S. PATENT DOCUMENTS

| | | | |
|---|---|---|---|
| 2,047,713 | 7/1936 | Simpson | 209/240 |
| 4,251,354 | 2/1981 | Lower | 209/240 |
| 4,319,990 | 3/1982 | Muller | 209/240 |
| 4,659,117 | 4/1987 | Holzhausen et al. | 285/226 X |
| 4,814,071 | 3/1989 | Lower | 209/240 X |
| 4,899,669 | 2/1990 | Dumbaugh | 198/771 X |

FOREIGN PATENT DOCUMENTS

| | | | |
|---|---|---|---|
| 0624056 | 8/1978 | U.S.S.R. | 285/9.2 |

*Primary Examiner*—Joseph E. Valenza
*Assistant Examiner*—Tuan N. Nguyen
*Attorney, Agent, or Firm*—Wood, Herron & Evans

[57] ABSTRACT

A dust seal connector for accommodating the relative movement between the enclosed, moving screen box of a screening machine, and a fixed particle inlet or outlet conduit connected to the screen box. The relative movement occurs as sliding motion between a suspended flat slide plate and a wear ring below the slide plate, with which the plate is facially engaged. The plate is connected upwardly by an enclosed particle passage to the conduit or box member from which it is suspended, and communicates downwardly with an opening in the ring for the flow of particles. In a preferred embodiment the particles flow through an axially compressed corrugated sleeve which connects the plate to the member from which it is suspended, compression of the sleeve biasing the ring and plate together to maintain a sliding dust seal between them. The sleeve is laterally stiff so as to limit movement of the plate relative to the member from which it is suspended, so that the plate slides over but does not follow the relatively moving ring to uncover the opening in the ring or impact against the suspending member.

12 Claims, 2 Drawing Sheets

SLIDING CONDUIT CONNECTOR FOR SCREENING MACHINE

FIELD OF THE INVENTION

This invention relates to screening machines, and more particularly to a sliding, sealed connection through which particles can be conducted between the movable screen box of a screening machine, and a fixed inlet or outlet conduit.

BACKGROUND

Screening machines, that is, machines having one or more screens for sizing, sifting, or separating particulate materials by vibratory, oscillatory, or gyratory movement of the screen, are in widespread commercial use. The screen or screens of such machines are mounted and housed within an enclosure called a screen box. The box provides a housing which prevents dust or fines from escaping during operation, as well as preventing outside dirt from contaminating the product being screened. One example of such machines is the "Rotex" brand machine produced and sold by the assignee of this application. The particle mix to be separated is introduced into the box and deposited on the screen; screening movement applied to the box separates different size or shape fractions of the particulate feed according to the size and shape of the screen openings. The material to be screened is fed from a source such as a hopper or elevator to an inlet conduit and falls through an opening in a so-called "top cover" over the screen box, onto the top screen. After separation by the screen, the various separated fractions fall from the screen box to one or more separate outlet conduits. Because the box moves in a rapid screening motion, provision must be made for accommodating its motion relative to stationary inlet and outlet conduits while still enclosing the falling particles and preventing dust from escaping from the screen box.

THE PRIOR ART

It has been common practice to use a flexible conduit or sleeve to connect the inlet and/or outlet conduit to the screen box in order to accommodate the relative motion between them, as for example shown in Simpson U.S. Pat. No. 2,047,713. For this purpose a flexible, corrugated sleeve is connected at one end to the fixed inlet or outlet conduit and at the other (moving) end to the opening into or out of of the screen box. However, such sleeves are subjected to constant flexing by the motion of the box, as a result of which the rate of sleeve failure is more rapid than is desirable. The rate of sleeve degradation is more rapid still where the incoming particle mix is at an elevated temperature.

Lower U.S. Pat. No. 4,251,354 discloses a particle inlet or outlet conduit which makes a sliding seal with a screen box. A low friction slide ring is mounted around the end of the conduit by a nearly flat, flexible apertured diaphragm, and is facially engaged with and slidable on an apertured wear plate. Motion of the box causes the ring to move in relation to the opening of the slide plate, the opening in the ring being larger than that in the wear plate so that the ring (which is positioned on top of the plate) encircles the opening through the plate for continuous particle flow. Leaf springs bias the ring downwardly into facial engagement with the plate.

It has been found that the usefulness of couplings of the type described in the '354 patent is limited. The opening in the plate must be smaller than the ring, so that the ring and diaphragm will always cover it. As a result, particles collect on the plate around the opening through it. The sliding movement of the ring usually tends to scrape most of the particles on the plate through the plate opening, but over time a build-up often occurs which lifts the rings it slides, permitting fines to escape or dirt to enter through the resulting gap between the ring and plate.

Moreover, the diaphragm which connects the conduit to the ring is cyclically stressed in compression and tension by the back and forth or gyratory movement of the screening box; and over time this leads to cracking and ultimately rupture of the diaphragm. Still another problem is that the diaphragm, which must be in the form of a low angle cone (nearly a planar sheet) in order to carry the tension stress to which it is subjected, accommodates only a very limited amount of vertical movement between the ring and the conduit connected to it. In many cases the screen box has a vertical component of motion (i.e., motion transverse to the plane of the ring) which approaches or exceeds the limit and which would lift the ring from the plate, thereby breaking the dust seal; a diaphragm seal cannot be used in such instances.

A related approach, which permits free vertical movement of a sliding coupling, has been to eliminate the diaphragm by simply passing the fixed conduit through an opening in a slide plate. The plate rests on and slides over a slide ring in the form of a "donut" made of tubing with a Teflon strip wrapped around it, the ring being secured around the opening to the screen box. The plate is not sealed or even connected to the conduit, and so can slide freely up and down on it to follow vertical movement. However, this approach has proven inadequate for dust control; dust escapes through the annular gap between the plate and conduit, there being no diaphragm. Moreover, the plate impacts against the conduit as it follows the movement of the ring, which is noisy and increases wear rapidly. Further, it is difficult to mount and position the ring horizontally, and gaps or spaces appear in the Teflon winding.

Thus there has been a need for a connection which can better accommodate both the lateral and the vertical movements involved, yet which will provide longer life while providing an effective dust seal.

BRIEF DESCRIPTION OF THE INVENTION

In accordance with this invention, an improved sliding coupling is provided between the enclosed screen box and the fixed inlet or outlet conduit. A slide plate having a center opening rests on a low friction wear ring beneath it. The plate is suspended by a particle passage below the fixed conduit, or below the box opening, so that particles will fall through it; and the ring is connected to the other opening. The passage from which the plate is suspended is sufficiently stiff in lateral directions that the plate can move sideways only to an insignificant extent, if at all, with respect to the member from which it is suspended. Spring means presses the plate and ring facially together. A corrugated sleeve which is axially compressed and laterally stiff is preferred as both the particle passage and the spring means; it can itself provide a biasing force sufficient to hold the ring and plate in facial engagement with one another. Alternatively, the biasing force can be provided by or supplemented with separate springs. The particle opening in the slide plate is smaller than the opening in the ring so that the plate covers the surface of the ring throughout the cycle of motion. This prevents particle accumulation between the plate and ring.

In one specific embodiment an upper end of a corrugated sleeve is connected around a fixed inlet chute and its other (lower) end is connected around the opening in the side plate. The sleeve is axially compressed so as to exert a downward force that holds the plate on the ring which is mounted to and moves with the box. The sleeve is laterally stiff so as to prevent the plate from following movement of the ring, while its axial compression constantly holds the plate down on the ring. Thus the plate can slide over the ring without substantially moving relative to the inlet or impacting against it, while still following vertical movement of the ring. The corrugated sleeve provided herein differs from the sleeves conventionally used to connect to screen boxes in that it is so stiff that it acts as a spring, both vertically and laterally. It exerts vertical spring force on the plate to hold the plate facially on the ring, and it exerts lateral force to resist following the sidewise movement of the ring, whereas the conventionally used corrugated sleeves have no useful spring effect.

This structure eliminates the need for the diaphragm and leaf springs of the '354 patent. Moreover, the corrugated sleeve accommodates a much greater range of axial movement than the nearly flat diaphragm of the '354 patent. Still further, the lateral stiffness of the sleeve has been found to better accommodate the back and forth (push-pull) stress which the screening movement applies, than a flat diaphragm does; and it eliminates impact of an unconnected plate against a fixed conduit.

DESCRIPTION OF THE DRAWINGS

The invention can best be further described by reference to the accompanying drawings, in which.

DETAILED DESCRIPTION

Figure 1:
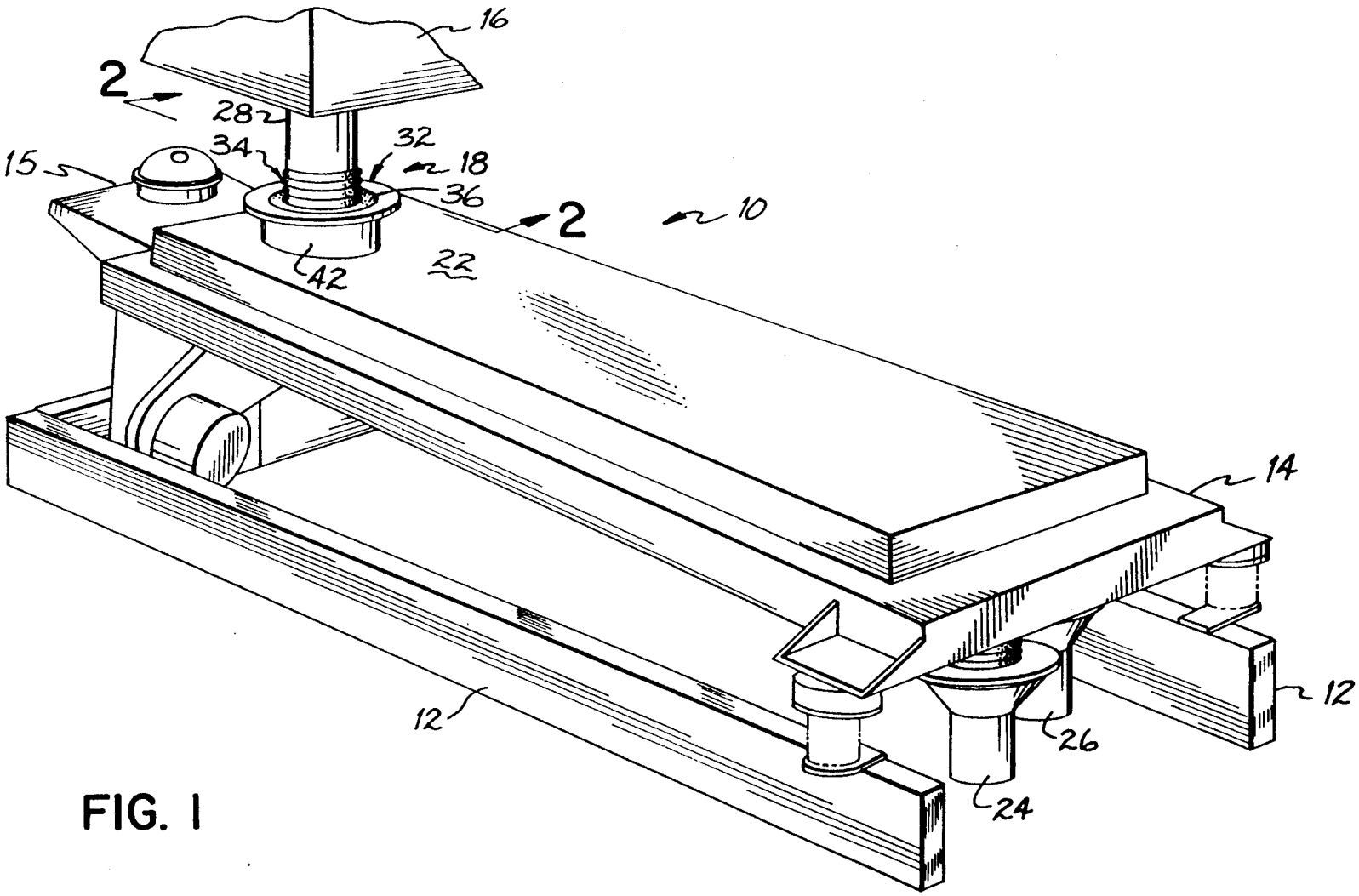
FIG. 1 is a perspective view of a screening machine equipped with sliding conduit connections in accordance with the invention at both the inlet and outlet ends of the screen box.

For purposes of explanation, FIG. 1 illustrates use of the invention with a screening machine of the "Rotex" type, but it should be understood that the invention is not limited to use with machines of that type. The machine designated generally by 10, includes a floor mount 12 on which a tilted screen box 14 is movably supported. A drive 15 generates a gyratory screening motion that is applied to the head end of the box 14. The screening movement of the screen box is largely orbital at the head end, and nearly linear at the foot end, and may also include a vertical component of motion of as much as 1-2 inches.

Particulate material to be screened is fed from a hopper 16 or other supply through a sliding inlet connection 18 in accordance with the invention, into the screen box 14 through an opening 20 (FIG. 2) in the box top cover 22. The top cover is secured to and moves with screen box 14 in the screening movement. Box 14 mounts at least one, and usually a stack of screens (not shown). Oversize particles, that is particles which do not pass through the top screen, are discharged off the lower end of the top screen into an "overs" outlet conduit 24 at the lower end of the screen. Smaller sized particles, which pass through one or more screens, are discharged through one or more "fines" outlet 26. The feed hopper 16 and the outlet conduits 24 and 26 are relatively fixed, that is, they do not move with the screen box.

Figure 2:
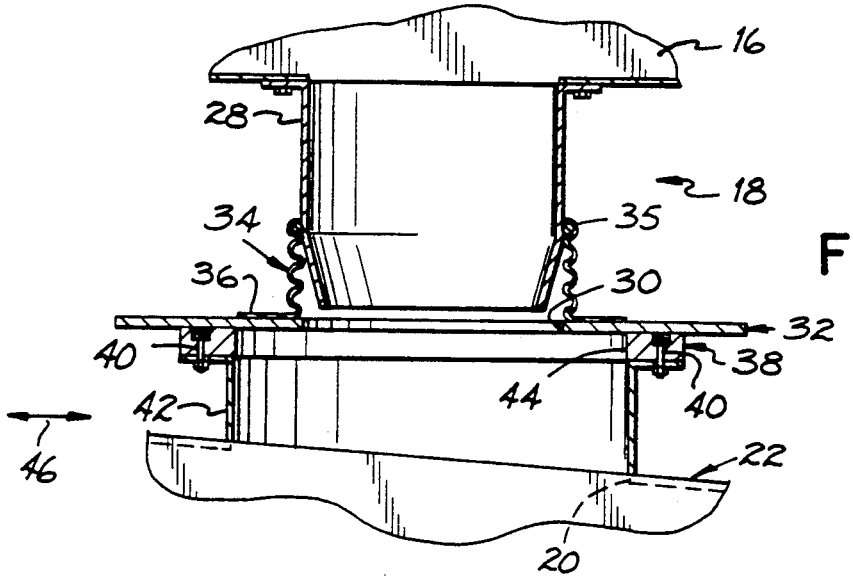
FIG. 2 is an enlarged axial section of the inlet connection, taken on line 2—2 of FIG. 1 of the inlet connection.

The inlet connection 18 is shown in more detail in FIG. 2. A tubular inlet conduit 28, which may have an inward taper downwardly, is secured below the hopper 16. Material discharged from hopper 16 falls through a particle passage or conduit 28 and passes through an opening 30 in a flat slide plate or disk 32. Plate 32 is suspended from hopper 16, preferably from conduit 28, by a corrugated sleeve 34. In the embodiment shown sleeve 34 is secured at its upper edge to a bead or rib 35 around conduit 28. An enlarged flange 36, formed around the lower end of sleeve 34, is secured as by adhesive, rivets, or other suitable means to the plate, around the plate opening 30. The opening 30 is larger than the opening of the bottom of inlet conduit 28; it is preferred that the conduit not extend into opening 30. (This facilitates sleeve installation and replacement in the field.) Plate 32 functions as a slide plate, as will be described.

A wear ring 38 is secured as by recessed bolts 40 to an outwardly projecting flange on a tube 42 that encircles the opening 20 in top cover 22. Wear ring 38 is preferably cast of a low friction material such as ultra high molecular weight polyethylene ("UHMW") or Teflon (the latter being especially suitable for high temperature application). It is alternatively or additionally possible, but more expensive, to make plate 32 of low friction material, to facilitate free relative movement between the two.

Wear ring 38 has a central opening 44, and it should be noted that this opening is substantially larger than the opening 30 in plate 32. The plate rests on the upper surface of wear ring 38 in facial engagement with it.

Sleeve 34 is designed to be stiff axially so as to exert a downward biasing force on the plate to hold the plate in facial engagement with wear ring 38 and maintain a dust tight seal between them. Further, the sleeve should have sufficient lateral (radial) stiffness that it holds the plate from following the relative lateral movement of the ring against which it is pressed. Thus the sleeve isolates the fixed hopper from movement of the box. By way of example, a corrugated sleeve of Ethylene-propylene diene monomer ("EPDM"), 5" long, with a wall thickness of 5/32" and 3 convolutions of ¼ radius spaced on 1½ centers, works well as the inlet sleeve 34 on a Rotex machine having a screen area of 60"×144". The slide plate for such a machine may weigh about 25 pounds and in use may be subject to a sidewise acceleration of about 2 g. Thus the specific sleeve described resists a dynamic lateral force of about 50 pounds. The sleeve 34 for such an installation exerts a downward force of about 35-40 lbs. on the slide plate whereas the conventional coupling sleeve previously used to connect the inlet to the screen box is not compressed at all in use, and indeed could exert only 2-10 pounds axial force before it would collapse axially.

Figure 3:
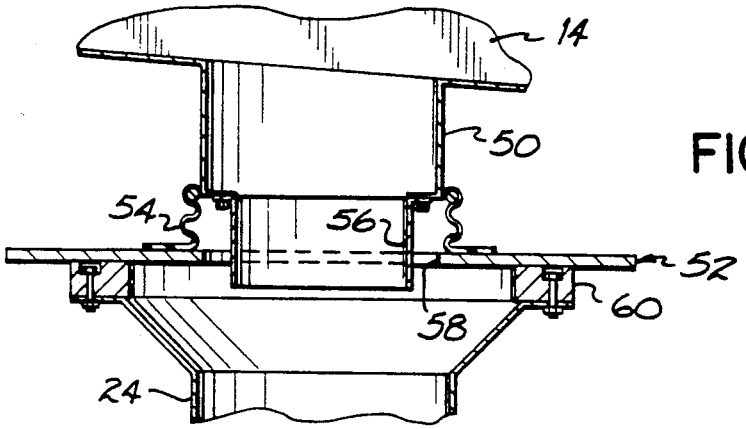
FIG. 3 is an enlarged axial section of one type of outlet connection in accordance with the invention.

The stiffness results in part from the short length of the sleeve; it preferably has only 1-3 convolutions (see FIGS. 2 and 3). If there are too many convolutions, it is too flexible laterally; and if too few or none, it is not axially compressible.

In operation the screen box moves in a gyratory or reciprocal motion as indicated by the arrows 46, while inlet conduit 28 remains stationary. A sliding seal is maintained between slide plate 32 and wear ring 38. Sleeve 34 prevents significant plate displacement in the lateral direction, supplying a counterforce which resists the drag of the plate 32 on ring 38; the plate may move slightly, but its movement is much less than the ring. Sleeve 36 normally does not abut or engage the side wall of the inlet conduit 28 at the bottom. Where the motion of the machine is such that the screen box has a vertical component of motion as well as a longitudinal component, sleeve 34 compresses and relaxes axially to follow the up and down motion.

The size of the ring opening 44 is sufficiently larger than that of the opening 30 of plate 32 that at all times during the screening cycle the upper surface of the ring is covered by the plate. Particles can never deposit or accumulate on the ring so as to cause the plate to lift and separate from facial engagement with the ring. This contrasts with the structure of the '354 patent in which the ring rides on top of the plate and has a larger opening than the plate. Comparative tests have shown that the life of the corrugated sleeve is substantially better than that of a flexible sleeve connected directly from the conduit to the screen box, and also better than that of the sliding seal of the '354 patent. Although the present sleeve is exposed to the screening movement, greater vertical dimension enables it to better absorb the axial stress. Moreover, the sleeve can provide its own self-biasing action to hold the plate against the ring; especially where the sleeve is above the plate, no added weights or assisting coil or leaf springs are needed. Further, installation of a new sleeve, ring or plate is simplified: the entire connector assembly is easily removed or accessed by removing the bolts mounting the inlet conduit to hopper 16.

FIG. 3 shows one type of outlet conduit connection in accordance with the invention. A particle passage in the form of an outlet chute 50 is secured to the bottom of screen box 14 around an outlet opening therein. A slide plate 52 is suspended by a corrugated sleeve 54 from chute 50. Wear ring 60 is secured by recessed bolts to the upper end of a fixed outlet conduit 24. As in the first described embodiment, the slide plate is above the ring and at all times covers it. Unlike the first embodiment, however, in this embodiment the slide plate is suspended from the moving assembly, i.e., the screen box, and the wear ring is connected to the stationary outlet assembly. Because the plate is mounted from and moves with the screen box in this embodiment, it is desirable to use a laterally stiffer sleeve to counter the greater lateral force that tends to displace the slide plate relative to the box opening. For this purpose the sleeve may be shorter than that of the FIG. 2 embodiment, preferably having only about 1 or 1½ convolutions; or it can be thicker, or made of less flexible elastomeric material. As before, the sleeve presses the slide plate downwardly against the wear ring. As a safety precaution, a chute extension 56 preferably projects through the opening 58 in the slide plate. Should sleeve 54 ever rupture, tube 56 would then prevent the slide plate from being thrown off the ring.

Figure 4:
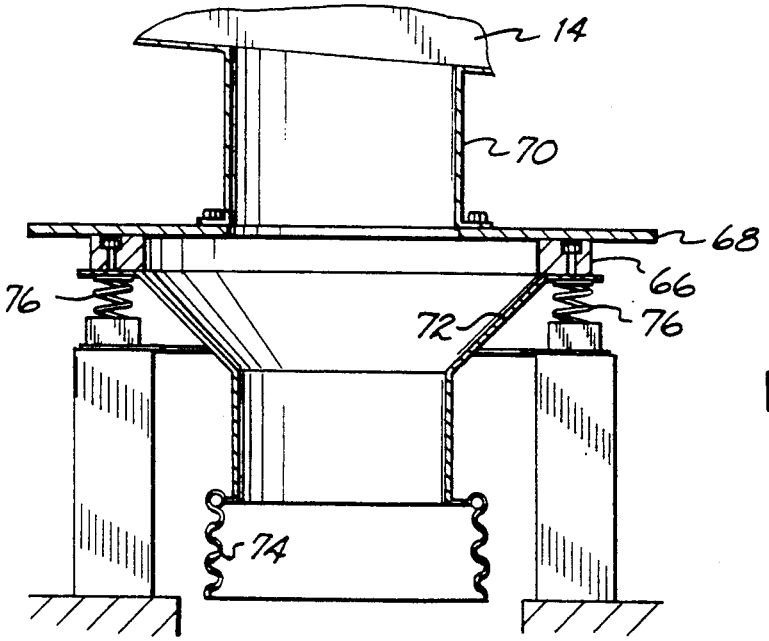
FIG. 4 is a vertical section of a second embodiment of outlet connection in accordance with the invention.

In the alternative outlet embodiment of FIG. 4 the wear ring 66 is pressed upwardly against the slide plate 68 which is rigidly bolted to an outlet chute 70 on the screen box 14. Wear ring 66 is mounted to a top flange on an outlet conduit 72. Movability between conduit 72 and a fixed outlet (not shown) is provided by a corrugated sleeve 74 connected between the outlet conduit 72 and the fixed outlet. Although the sleeve 74 may be axially compressed and may tend to bias the outlet conduit and wear ring 66 upwardly against the slide plate, that biasing force is preferably assisted by a plurality of coil or other springs 76, 76. This embodiment still provides the advantages that the material cannot accumulate on the wear ring, longer surface life for the flexible conduit 74, and a greater range of vertical movement, but it is more complicated in the use of supplementary springs to provide the biasing force to hold the wear ring upwardly against the slide plate. The spring means, whether an axially compressed corrugated sleeve, or a coil or other spring, should exert sufficient vertical thrust that the seal is maintained while the sliding members follow the vertical movement of the screen box; and the spring means should exert sufficient lateral stiffness that the plate does not follow the relative lateral movement of the ring and does not impact upon its mounting.

Having described the invention, what is claimed is:

1. A sliding conduit connector between a particle opening of a movable screen box of a screening machine, and a fixed particle conduit, said connector comprising, a slide plate having an opening for the flow of particles therethrough, said plate being suspended from and connected by a particle passage to one of said fixed conduit and said opening of said box, said particle passage being inflexible laterally to prevent said plate from moving sideways relative to the said one of said conduit and opening from which it is suspended.

said plate residing on and in peripheral engagement with a wear ring having an open center for the flow of the particles therethrough from the opening of said slide plate, said ring mounted to and above the other of said conduit and said opening of said box, and spring means biasing said plate and ring vertically in facial engagement with one another, said connector including a flexible sleeve through which particles pass and which is axially compressible and extensible to accommodate vertical movement of the box relative to the fixed conduit, the open center of said ring being sufficiently larger than the opening in said plate that lateral movement between said plate and said ring in operation does not uncover the upper surface of said ring to the accumulation of particles thereon, said flexible sleeve being made of an elastomer and itself providing said spring means, said sleeve being axially compressed sufficiently to hold said plate against said ring during operation and having sufficient lateral stiffness to prevent substantial relative lateral movement of said plate, said sleeve having an outward flange around a lower end, said flange being secured to said plate.

2. A sliding conduit connector between a particle opening of a movable screen box of a screening machine, and a fixed particle conduit, said connector comprising, a slide plate having an opening for the flow of particles therethrough, said plate being suspended from and connected by a particle passage to one of said fixed conduit and said opening of said box, said particle passage being inflexible laterally to prevent said plate from moving sideways relative to said one of said conduit and opening from which it is suspended, said plate residing on and in peripheral engagement with a wear ring having an open center for the flow of the particles therethrough from the opening of said slide plate, said ring mounted to and above the other of said conduit or said opening of said box, and spring means biasing said plate and ring vertically in facial engagement with one another, said connector including a flexible sleeve through which particles pass and which is axially compressible and extensible to accommodate vertical movement of the box relative to the fixed conduit, the open center of said ring being sufficiently larger than the opening in said plate that lateral movement between said plate and said ring in operation does not uncover the upper surface of said ring to the accumulation of particles thereon, said flexible sleeve being made of an elastomer and itself providing said spring means, said sleeve being axially compressed sufficiently to hold said plate against said ring during operation and having sufficient lateral stiffness to prevent substantial relative lateral movement of said plate.

said plate being suspended from a fixed inlet conduit and snapped around said inlet conduit.

3. A sliding conduit connector between a particle opening to a movable screen box of a screening machine, and a fixed particle inlet conduit, said connection comprising, a slide plate having an opening for the flow of particles therethrough. said plate being suspended from said fixed conduit and connected to it by a corrugated sleeve, said plate residing on and in facial engagement with a wear ring having an open center for the flow of the particles therethrough from the opening of said slide plate, said ring mounted to and above said opening of said box, and said corrugated sleeve being under axial compression and biasing said plate downwardly in facial engagement with said ring, said sleeve being laterally stiff and resisting lateral movement of said plate with said ring, said sleeve being compressible to accommodate vertical movement of the box relative to the fixed conduit, the open center of said ring being sufficiently larger than the opening in said plate that lateral movement of said ring relative to said plate in operation does not uncover the upper surface of said ring to the accumulation of particles thereon.

4. A sliding conduit connector between a particle opening from a movable screen box of a screening machine, and a fixed particle outlet conduit, said connection comprising, a slide plate having an opening for the flow of particles therethrough, said plate being suspended from and connected by a corrugated sleeve to said opening from said box, said plate residing on and in facial engagement with a fixed wear ring having an open center for the flow of the particles therethrough from the opening of said slide plate, said ring secured to and above said fixed outlet conduit, said corrugated sleeve being under axial compression and biasing said plate downwardly in facial engagement with said ring while resisting lateral movement of said plate relative to said opening from said box, said sleeve being compressible to accommodate vertical movement of the box relative to the fixed outlet conduit, the open center of said ring being sufficiently larger than the opening in said plate that lateral movement of said opening of said box relative to said ring in operation does not uncover the upper surface of said ring to the accumulation of particles thereon.

5. A corrugated sleeve for connecting an inlet conduit of a screening machine to a slide element of a sliding particle conduit connector, said sleeve functioning both as a spring and as a particle conduit, said sleeve being axially compressible as a spring to exert an axial force when compressed axially, which force is sufficient to maintain a sliding seal of said slide element while permitting said slide element to follow vertical movements of said sliding connector, said sleeve having sufficient lateral stiffness to prevent said slide element from substantially following lateral movement of said connector, said sleeve having an outward flange for securing the flange to a slide element.

6. The sliding conduit connector of claim 1, 2, 3, 4 or 5 wherein said sleeve is corrugated.

7. The sliding conduit connector of claim 1, 2, 3, 4 or 5 wherein said sleeve has a total of 1 to 3 convolutions.

8. The sliding conduit connector of claim 1, 2, 3, 4 or 5 wherein said sleeve is ethylene-propylene diene monomer rubber.

9. The sliding conduit connector of claim 1 or 2 wherein said plate is suspended from a fixed inlet conduit.

10. The sliding conduit connector of claim 1, 2, 3, 4 or 5 wherein said ring is cast of ultra high molecular weight polyethylene.

11. The corrugated sleeve of claim 5 being axially compressible sufficiently to apply an axial force of at least about 35 pounds.

12. The corrugated sleeve of claim 11 having sufficient lateral stiffness to effectively resist deflection by a sidewise force of about 50 pounds.

* * * * *